US010788193B2

(12) United States Patent
Genenbacher

(10) Patent No.: US 10,788,193 B2
(45) Date of Patent: Sep. 29, 2020

(54) REMOVABLE CLAMP FOR DECORATIVE LIGHTS

(71) Applicant: Shawn Michael Genenbacher, Lubbock, TX (US)

(72) Inventor: Shawn Michael Genenbacher, Lubbock, TX (US)

( * ) Notice: Subject to any disclaimer, the term of this patent is extended or adjusted under 35 U.S.C. 154(b) by 138 days.

(21) Appl. No.: 16/045,849

(22) Filed: Jul. 26, 2018

(65) Prior Publication Data

US 2020/0032989 A1 Jan. 30, 2020

(51) Int. Cl.

| | |
|---|---|
| ***F21V 21/00*** | (2006.01) |
| ***F21V 21/088*** | (2006.01) |
| ***F21V 21/096*** | (2006.01) |
| ***F21S 4/10*** | (2016.01) |
| *F21W 121/00* | (2006.01) |

(52) U.S. Cl.

CPC ..... *F21V 21/088* (2013.01); *F21S 4/10* (2016.01); *F21V 21/096* (2013.01); *F21W 2121/00* (2013.01)

(58) Field of Classification Search

CPC ..... F21S 4/10; F21V 21/088

See application file for complete search history.

(56) References Cited

U.S. PATENT DOCUMENTS 3,927,315 A * 12/1975 Werry ..... F21V 21/02 362/382
5,161,881 A * 11/1992 Myson ..... F21V 21/002 362/249.14
5,707,136 A * 1/1998 Byers ..... F21V 3/02 362/145
6,176,600 B1 1/2001 Huang
6,259,346 B1 7/2001 Nakano
7,549,779 B2 6/2009 Genenbacher
8,308,323 B2 11/2012 Holland
9,630,769 B2 4/2017 Schultz
2001/0038159 A1 11/2001 Maranca et al.
2011/0305028 A1 12/2011 Scott
2012/0069587 A1 3/2012 Holland
2012/0280098 A1 11/2012 Rinck
2016/0230966 A1 8/2016 DeFrancesco et al.
2018/0320867 A1* 11/2018 Chang ..... F21V 21/088
2018/0320868 A1* 11/2018 Chang ..... F21V 3/00

OTHER PUBLICATIONS

International Search Report and Written Opinion for PCT/US2019/042103 dated Oct. 4, 2019, 12 pgs.

* cited by examiner

*Primary Examiner* — Andrew J Coughlin
(74) *Attorney, Agent, or Firm* — Vincent J. Allen; J. Miguel Hernandez; Carstens & Cahoon, LLP

(57) ABSTRACT

A removable clamp for a light string is provided. The removable clamp includes a base with engagement members designed to engage a portion of a wire of the light string; a cap with a peripheral skirt and a set of friction members designed to engage with the engagement members of the base for engaging the portion of the wire; and a magnet embedded in the base of the removable case such that the magnet does not protrude outside the base. The removable clamp wraps around the portion of wire of the light string, and then attached via the magnet to a metal surface on the outside of a building.

35 Claims, 9 Drawing Sheets

REMOVABLE CLAMP FOR DECORATIVE LIGHTS

BACKGROUND OF INVENTION

1. Field of Invention

The present invention relates to removable clamps, and more particularly to removable clamps that facilitate the hanging of light strings on metal surfaces on the outside of buildings.

2. Description of Related Art Including Information Disclosed Under 37 C.F.R. 1.97 And 1.98

Decorative lights typically do not come provided with means for mounting them to display surfaces, such as housing sides. People have used many methods for hanging up decorative lights and other objects from the roof or on the side of their residence. For decorative lights, typically, staples or nails are used. Staples are used to staple the wire strand of the decorative lights to the roof edge or to the side of the residence, and nails are put in place so that the wire strand of the decorative lights wraps around the nails. However, stapling has several potential drawbacks, including damage to the mounting surface, which increases with repeated mounting and dismounting of the decorative lights, and potential damage to the wire strand of the decorative lights. The decorative lights installer is also exposed to injury during the stapling process. Nails also have similar drawbacks as staples.

It is desirable to have a method for temporarily mounting decorative lights (and other objects) to a mounting surface, such as a roofing edge, without the need for damaging the surface.

BRIEF SUMMARY

A removable clamp for a light string is provided. In an exemplary embodiment, the removable clamp comprises a base with engagement members designed to engage a portion of a wire in the light string. The removable clamp also comprises a cap, wherein the cap is attached to the base by a hinge connection at one side and is movable between a closed position and an open position, wherein the cap comprises a peripheral skirt and friction members, wherein the peripheral skirt comprises a first set of openings positioned on a plane parallel to the hinge connection in the closed position and the friction members are arranged to form a second set of openings on the plane parallel to the hinge connection in the closed position, wherein the portion of the wire is designed to fit in the first set of openings and in the second set of openings; wherein the open position of the cap exposes the engagement members of the base. The removable clamp may also comprise a magnet embedded in the base such that the magnet does not protrude outside of the base. In some embodiments, the clamp is made from plastic.

In some embodiments, the magnet is a neodymium magnet. The magnet can be a disc one half inch in diameter and ⅛ inch thick. The magnet can be embedded flush with a bottom surface of the base and is opposite the engagement members.

In some embodiments, the cross-sectional area of the base can be circular. In other embodiments, the cross-sectional area can be rectangular.

In another exemplary embodiment, a removable clamp for a light string is provided. The removable clamp comprises a base with engagement members designed to engage a portion of a wire in the light string; a cap wherein the cap comprises a peripheral skirt and a set of friction members, wherein the peripheral skirt comprises a first set of openings positioned on a plane perpendicular to a top surface of the base and the set of friction members is arranged to form a second set of openings on the plane perpendicular to the top surface of the base, wherein the portion of the wire is designed to fit in the first set of openings and in the second set of openings; and a magnet embedded in the base such that the magnet does not protrude outside of the base.

In some embodiments, the cap is a screw top with the first set of threads along an interior surface of the peripheral skirt and the base comprises a base skirt with a second set of threads along an exterior surface, and the cap engages the base via the first set of threads and the second set of threads.

In another exemplary embodiment, a method for installing a system of removable clamps for hanging a light string is provided. The method comprises selecting a location containing a ferrous metal surface. A portion of wire is positioned between engagement members of a base of a first removable clamp of the system of removable clamps. A cap of the first removable clamp is closed into a closed position from an open position, wherein the cap comprises a peripheral skirt and a friction member, wherein the peripheral skirt comprises a first set of openings positioned on a plane perpendicular to a top surface of the cap; and the friction member comprises a second set of openings on the plane perpendicular to the top surface of the cap, wherein the portion of the wire is designed to fit in the first set of openings and in the second set of openings. The base of the removable clamp is attached to the selected location via a magnet embedded in the base of the first removable clamp.

Other aspects, embodiments and features of the invention will become apparent in the following written detailed description and accompanying drawings.

BRIEF DESCRIPTION OF THE DRAWINGS

The present invention will be more fully understood by reference to the following detailed description of the preferred embodiments of the present invention when read in conjunction with the accompanying drawings, wherein.

Figure 1:
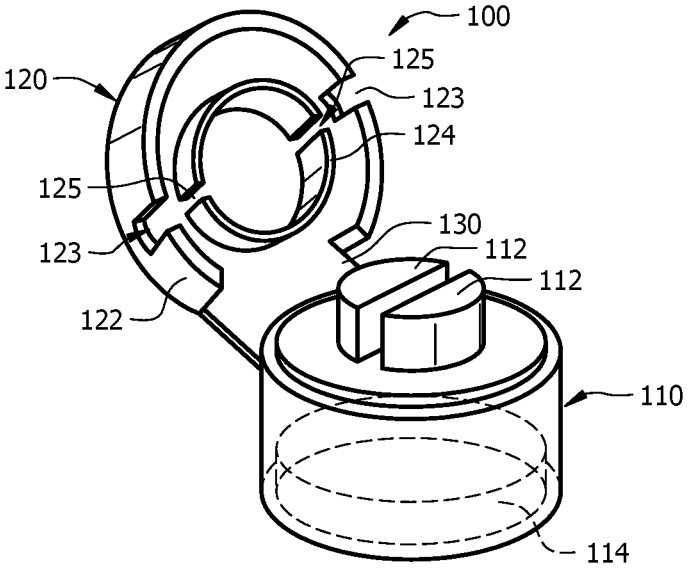
FIG. 1 is a perspective view of a first exemplary embodiment of a removable clamp in an open position in accordance with the disclosed principles.

The above figures are provided for the purpose of illustration and description only, and are not intended to define the limits of the disclosed invention. Use of the same reference number in multiple figures is intended to designate the same or similar parts. Furthermore, when the terms "top," "bottom," "first," "second," "upper," "lower," "height," "width," "length," "end," "side," "horizontal," "vertical," and similar terms are used herein, it should be understood that these terms have reference only to the structure shown in the drawing and are utilized only to facilitate describing the particular embodiment. The extension of the figures with respect to number, position, relationship, and dimensions of the parts to form the preferred embodiment will be explained or will be within the skill of the art after the following teachings of the present invention have been read and understood

DETAILED DESCRIPTION

The disclosed principles provide a number of innovations, including novel removable clamps and methods of using same for hanging a light string. The removable clamp and method of using the removable clamps can be used for hanging decorative lights along the edges of a roof. The removable clamp and method can also be used to hang other objects along the edges of a roof. A detailed discussion of the exemplary removable clamps is provided below; however, it should be understood that the embodiments described herein are only exemplary and do not limit the broader scope of the disclosed principles.

FIG. 1 is a perspective view of a first exemplary embodiment of a removable clamp in an open position in accordance with the disclosed principles. The exemplary removable clamps 100 is designed to hold a piece of wire of a light string between the base 110 and the cap 120 in a closed position, and then the clamp 100 is attached to a metal surface via the magnet 114 embedded in the base 110 of the clamp 100. A plurality of the exemplary removable clamp 100 can be used to facilitate hanging of a light string on metal surface on the outside of a building. In the exemplary embodiment, the base 110 and the cap 120 are made from plastic, and can be constructed using a molding process.

In the first exemplary embodiment, the base 110 of the removable clamp 100 comprises engagement members 112 protruding outwardly from the top surface of the base 110. In the first exemplary embodiment, the engagement members 112 are semi-circular protrusions arranged to fit a portion of wire of the light strand between the engagement members 112. In another embodiment, the engagement members 112 can be shaped as grooves in the base 110 to accommodate a portion of the wire of the light string.

Opposite of the engagement members 112 of the base 110 is the magnet 114 embedded in the base 110 of the removable clamp 100. The magnet 114 can be embedded so that the outward-facing surface of the magnet 114 is flush with the bottom surface of the base 110 and does not protrude out from the base 110. In one embodiment, the magnet is a neodymium magnet. The magnet can have pull strength ranging from 1 ounce to 16 pounds. In the exemplary embodiment, the magnet is a disc that is one-half (½) inch in diameter and one-eighth (⅛) of an inch thick. As mentioned previously, the magnet 114 allows for the removable clamp 110 to attach to metal surfaces on the outside of buildings and thereby facilitate the hanging of light strings on the outside of buildings.

Figure 2:
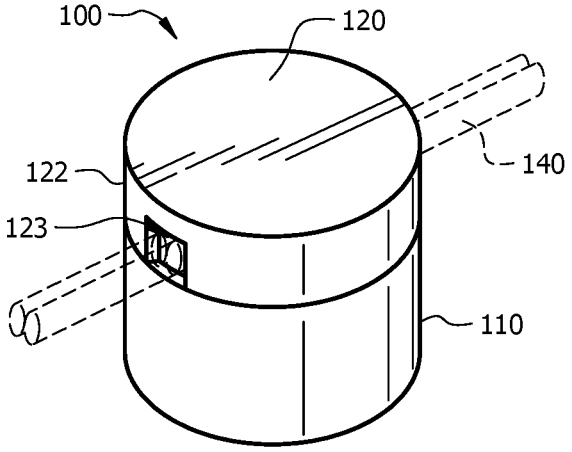
FIG. 2 is a perspective view of the first exemplary embodiment of the removable clamp in a closed position in accordance with the disclosed principles.

To ensure that the portion of wire of the light string is engaged with the removable clamp 100, the removable clamp 100 also comprises a cap 120 that closes around the engagement members 112 of the base 110 to form the closed position of the removable clamp 110, which is illustrated in FIG. 2. By having a cap that closes around the engagement members 112, the removable clamp 100 prevents the portion of wire from sliding up from or falling out from between the engagement members. The cap 120 comprises a peripheral skirt 122 with a first set of openings 123, and friction members 124 with a second set of openings 125. The first set of openings 123 and the second set of openings 125 are lined up with each other so that the portion of wire of the light string can pass through the openings 123 and 125. In the present exemplary embodiment, the cap 120 is attached to the base 110 via a hinge connection 130 on one side of the base. The hinge connection 130 is positioned so that the portion of wire positioned between the engagement members 112 can also pass through the first set of openings 123 and the second set of openings 125 when the cap 120 is moved into the closed position.

Figure 3:
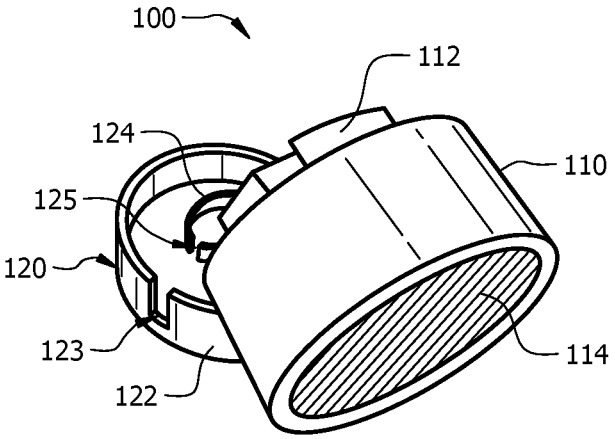
FIG. 3 is a bottom perspective view of the first exemplary embodiment of the removable clamp in the open position in accordance with the disclosed principles.

FIG. 2 is a perspective view of the first exemplary embodiment of the removable clamp in a closed position in accordance with the disclosed principles. As mentioned previously, the cap 120 is attached to the base 110 by a hinge connection 130 and the hinge connection 130 allows for the cap 120 to move from an open position to a closed position. In the closed position, the removable clamp 100 closes around the portion of wire 140 engaged by the engagement members (not shown), and the portion of wire 140 pass through the second set of openings (not shown) of the friction members (not shown) and through the first set of openings 123 of the peripheral skirt 122 of the cap 120. The first set of openings 123, the second set of openings 125, and the gap between the engagement members 112 are designed to accommodate the width of the wire 140, which can be any desired width for the application FIG. 3 is a bottom perspective view of the first exemplary embodiment of the removable clamp 100 in the open position in accordance with the disclosed principles. As mentioned previously, the magnet 114 of the removable clamp 100 is opposite of the engagement members 112 of the base 110 and is embedded in the base 110. In the exemplary embodiment, the magnet 114 is embedded such that the exposed surface or the outwardly-facing surface of the magnet 114 is flush with the bottom surface of the base 110 and is not protruding out from the base 110.

Figure 4:
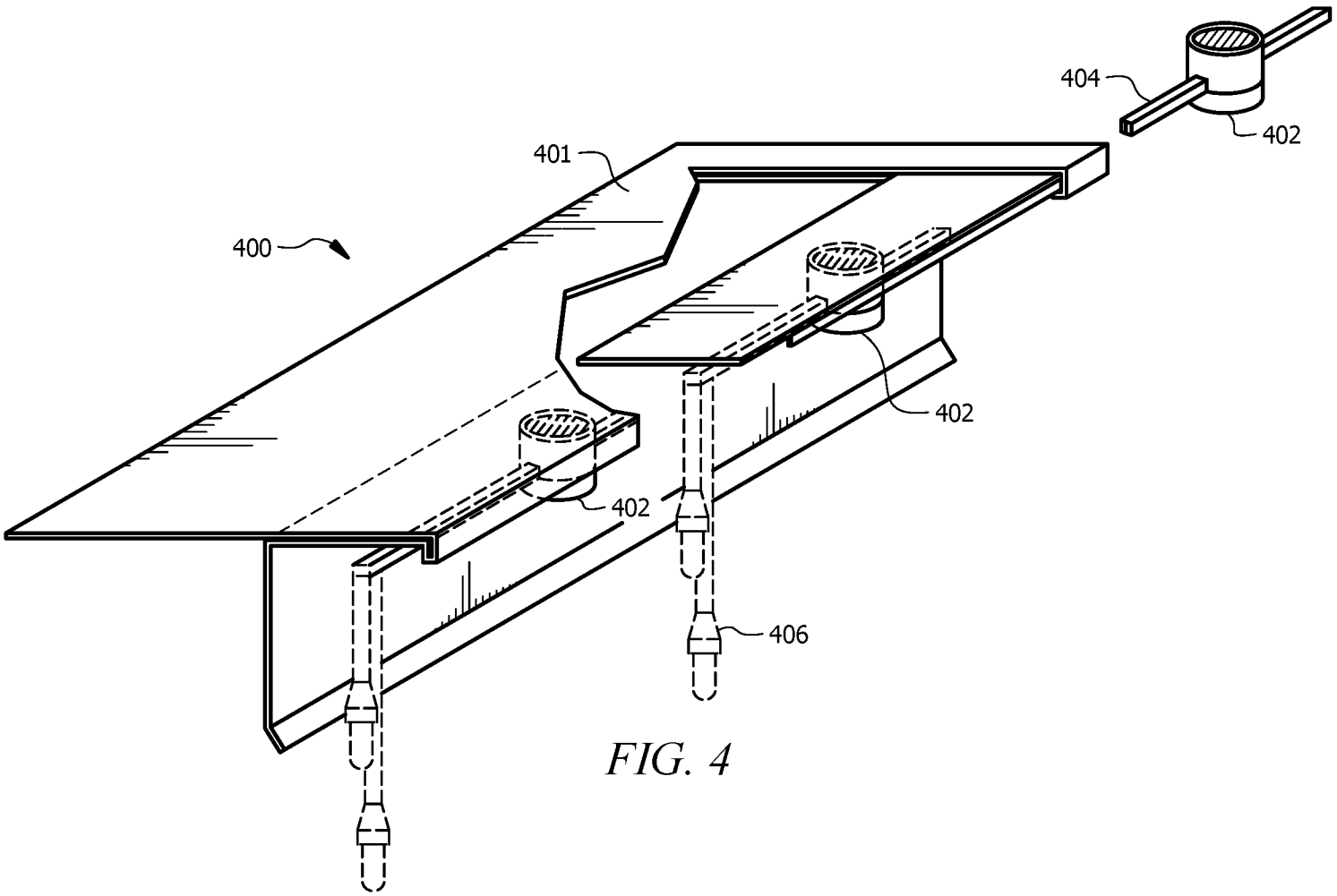
FIGS. 4 and 5 illustrates the first exemplary embodiment of the removable clamp used with a light string on a metal roofing edge hanger in accordance with the disclosed principles.
Figure 5:
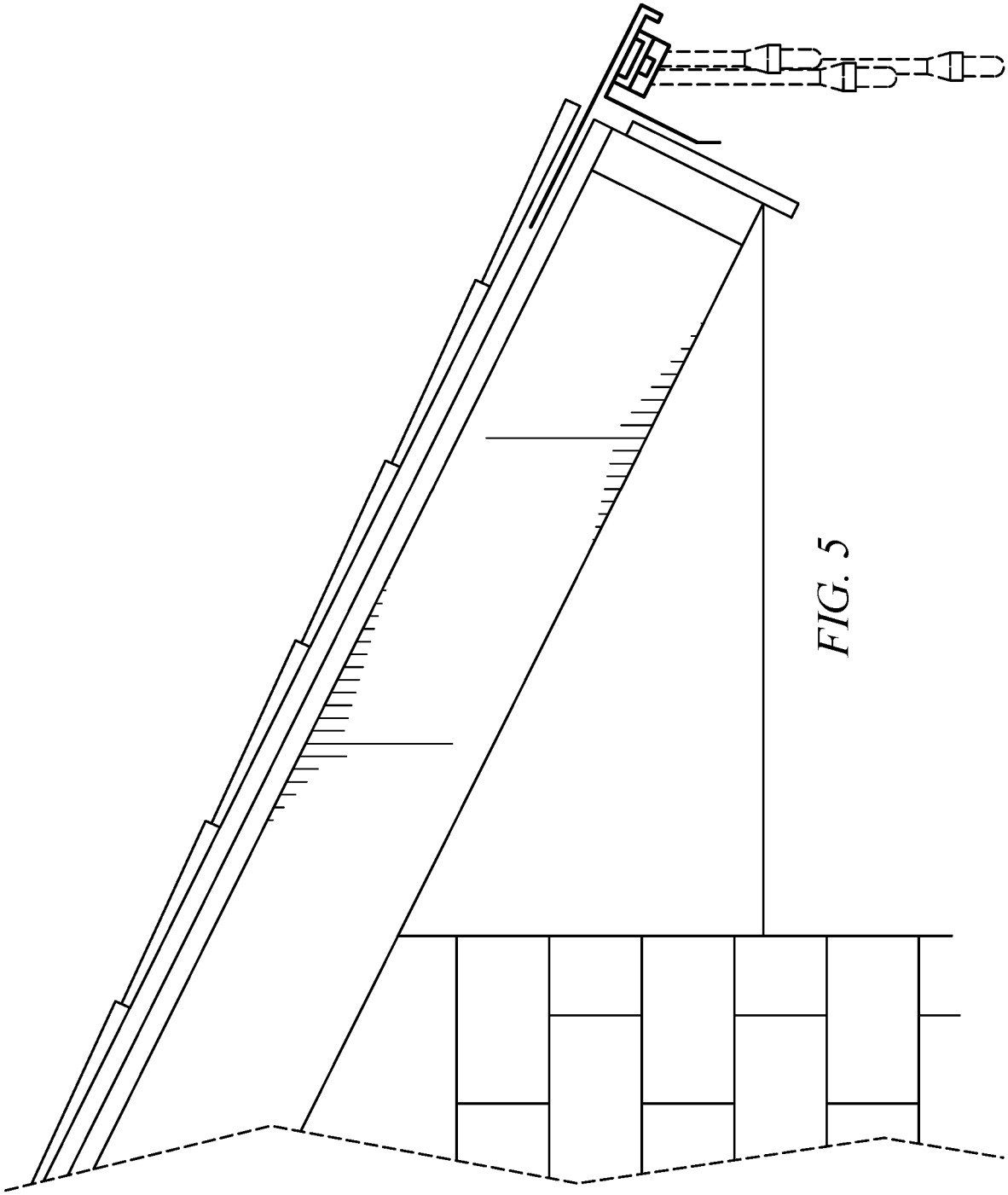

FIGS. 4 and 5 illustrates an exemplary embodiment of the removable clamps 400 used with a light string on a metal roofing edge hanger in accordance with the disclosed principles. FIG. 4 illustrates a plurality of removable clamps 400 in accordance with the first exemplary embodiment shown in FIGS. 1-3 used with a metal roofing edge hanger 401. As shown, the removable clamps 402 are closed around different portions of wire of the light string 404, and lights 406 may be located on the light string 404 between the removable clamps 402. The removable clamps are arranged so that the magnet faces the metal roofing edge hanger 401, and then the removable clamps 402 are attached to the hanger 401 via the magnetic force between the magnet of the removable clamps 402 and the metal of the hanger 401. In another embodiment, the removable clamps 401 can be attached to any type of ferrous metal surface or fascia on the outside of a building.

FIG. 5 depicts a side view of a removable clamp in the closed position around a portion of wire of a light string, with the removable clamp attached to a metal hanger. In other embodiments, the removable clamp can be attached to other portions of the metal hanger not shown with FIG. 5.

Figure 6A:
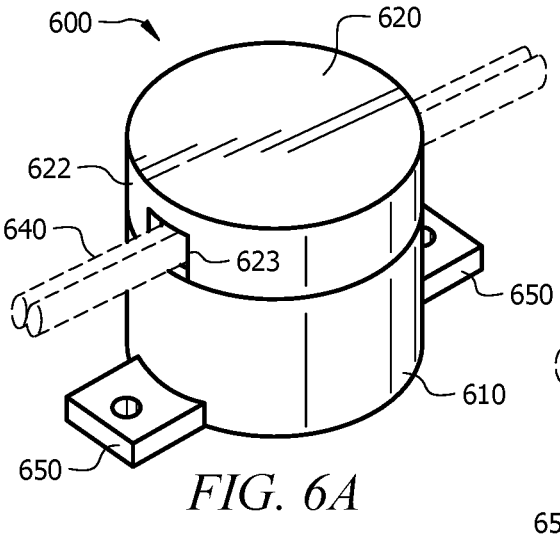
FIGS. 6A and 6B illustrate a second exemplary embodiment of the removable clamp in accordance with the disclosed principles.
Figure 6B:
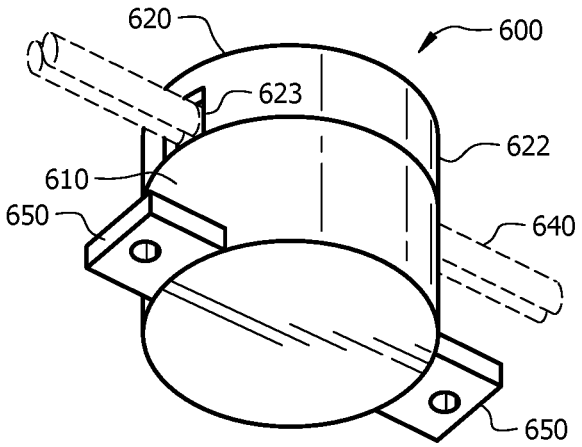

FIGS. 6A and 6B illustrate a second exemplary embodiment of the removable clamp in accordance with the disclosed principles. The removable clamp 600 comprises similar features as the exemplary embodiment shown in FIGS. 1-5: the removable clamp 600 wraps around a piece of wire 640 between the base 610 and the cap 620 by passing through a first set of openings 623 of the skirt 622 of the cap 620. The removable clamp further comprise tabs 650 protruding from the exterior surface of the base 610. In the present exemplary embodiment, the tabs 650 are located on opposite sides of each other on the base 610, and in other embodiments, can be located at any location along the perimeter of the base 610. In some embodiments, the tabs 650 are parallel to the portion of wire of a light string to be engaged with the clamp 600, and comprises holes for screws to pass through and hold the clamp 600 in place on a wood surface. In some embodiments, the tabs can be used with a slot mount, as shown in FIG. 7B. The tabs 750 of the present exemplary embodiment can be combined with any of the embodiments disclosed herein.

Figure 7A:
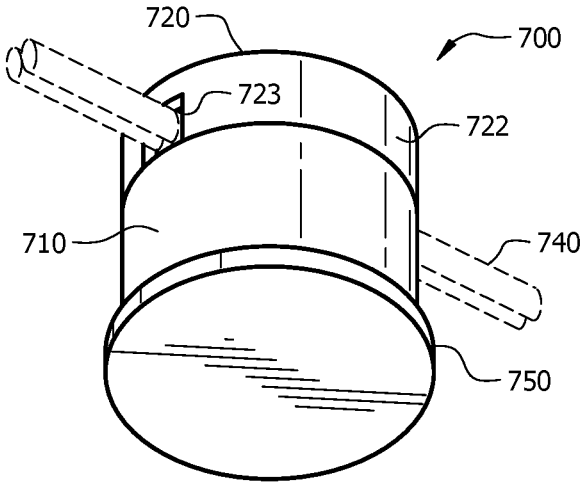
FIGS. 7A and 7B illustrate a third exemplary embodiment of the removable clamp in accordance with the disclosed principles.
Figure 7B:
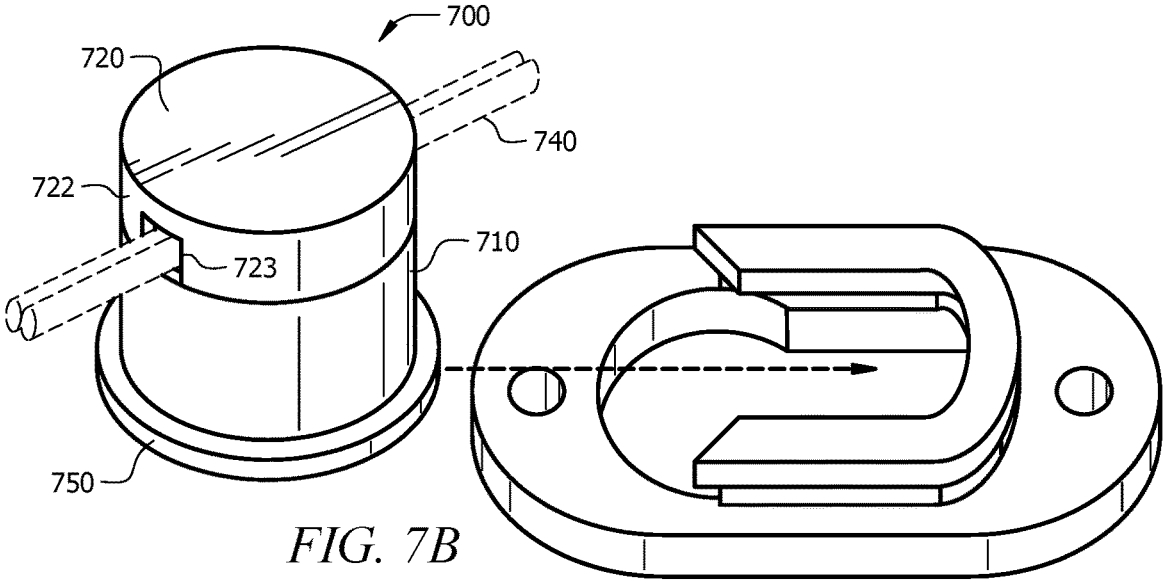

FIGS. 7A and 7B illustrate a third exemplary embodiment of the removable clamp in accordance with the disclosed principles. The removable clamp 700 comprises similar features as the exemplary embodiment shown in FIGS. 1-5: the removable clamp 700 wraps around a piece of wire 740 between the base 710 and the cap 720 by passing through a first set of openings 723 of the skirt 722 of the cap 720. The removable clamp further comprises a circular ring 750 protruding from the exterior surface of the base 710 and also wrapping around the bottom of the base 710. The present exemplary embodiment of the removable clamp 700 is designed to fit in any type of slot mount, one of which is shown in FIG. 7B. The ring 750 can comprise any diameter to fit in any size slot mount, and the ring 750 feature of the present exemplary embodiment can be combined with any of the embodiments disclosed herein.

Figure 8A:
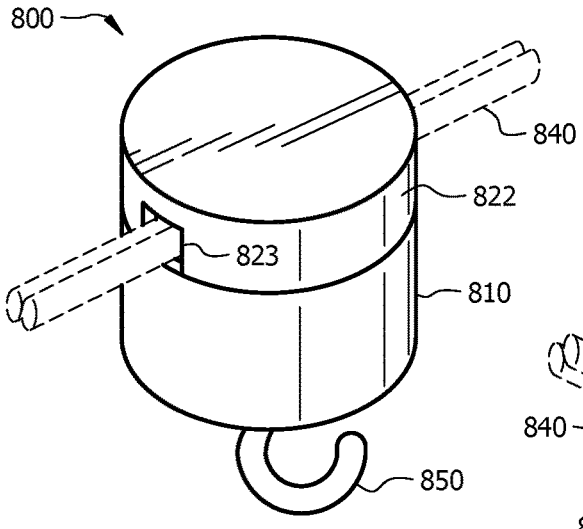
FIGS. 8A and 8B illustrate a fourth exemplary embodiment of the removable clamp in accordance with the disclosed principles.
Figure 8B:
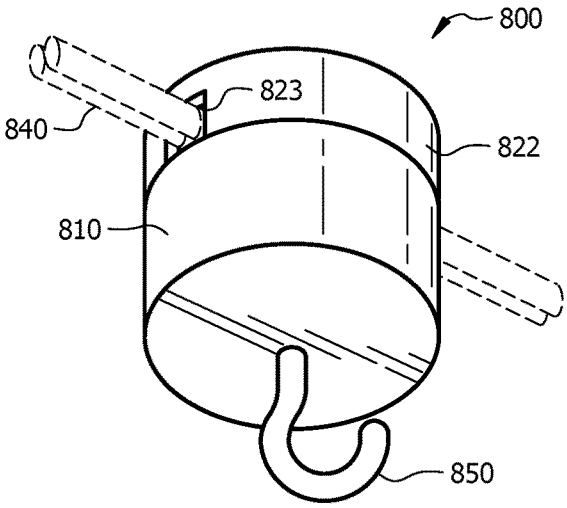

FIGS. 8A and 8B illustrate a fourth exemplary embodiment of the removable clamp in accordance with the disclosed principles. The removable clamp 800 comprises similar features as the exemplary embodiment shown in FIGS. 1-5: the removable clamp 800 wraps around a piece of wire 840 between the base 810 and the cap by passing through a first set of openings 823 of the skirt 822 of the cap 820. The removable clamp further comprises a hook 850 protruding from the bottom of the base 810. In the present exemplary embodiment, the hook 850 is located opposite the cap 822, and is centered on the bottom of the base 810 to provide maximum stability. The hook 850 can have any angle of curvature to accommodate suspending the clamp 800 from the ground. The hook 850 of the present exemplary embodiment can be combined with any of the embodiments disclosed herein.

Figure 9A:
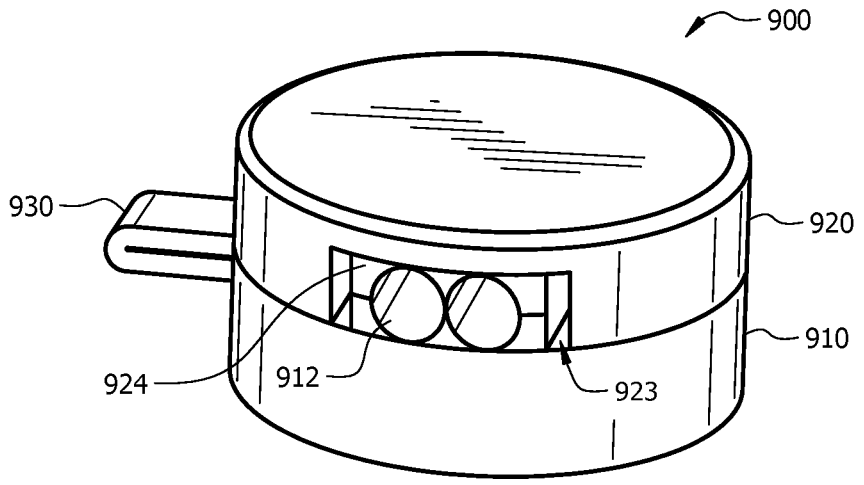
FIGS. 9A, 9B, and 9C illustrate a fifth exemplary embodiment of the removable clamp in accordance with the disclosed principles.
Figure 9B:
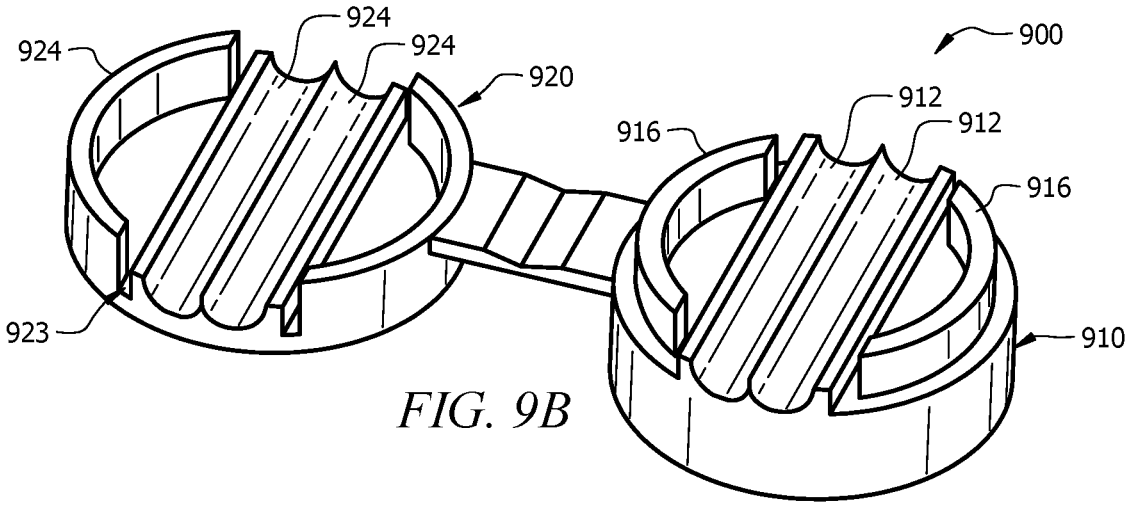
Figure 9C:
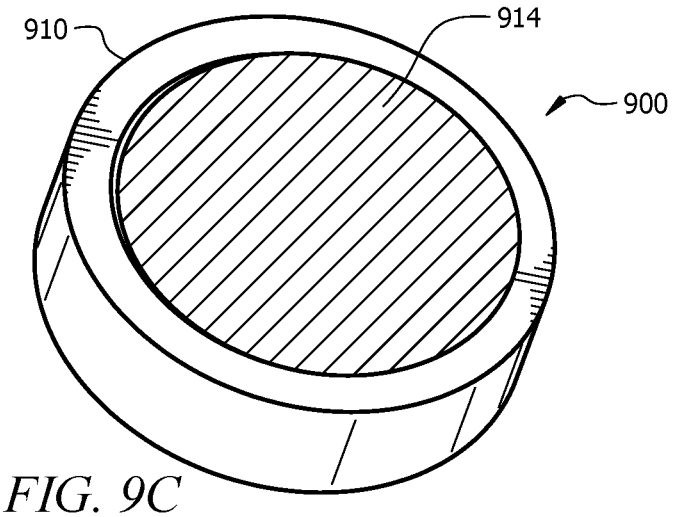

FIGS. 9A, 9B, and 9C illustrate a fifth exemplary embodiment of the removable clamp in accordance with the disclosed principles. As with the previous exemplary embodiments, the present exemplary embodiment of the removable clamp is designed to wrap around a portion of wire of a light string and to facilitate the hanging of the light string on metal surfaces on the outside of buildings. The exemplary removable clamp 900 comprises a base 910 and a cap 920, connected together by a hinge connection 930. The hinge connection 930 allows for the cap 920 to move from a closed position to an open position, as shown in FIGS. 9A and 9B.

In the open position shown in FIG. 9B, the engagement members 912 are exposed. As mentioned earlier, the engagement members 912 may have any shape to accommodate a portion of wire of the light string, and in the present exemplary embodiment, the engagement members 912 are shaped as grooves to accommodate the portion of wire of the light string. Similarly, the friction members 924 of the cap 920 may also have any shape to accommodate the portion of wire of the light string, and in the present exemplary embodiment, the friction members 924 are also shaped as grooves to accommodate the portion of wire of the light string. In the present exemplary embodiment, the engagement members 912 span the diameter of the base 910, and similarly, the friction members 924 span the diameter of the cap 910. By spanning the diameters of the base 910 and the cap 920, the engagement members 912 and the friction members 924 are exposed through a first set of openings 923 of the cap 920. In the present exemplary embodiment, the engagement members 912 and the friction members 924 are positioned parallel to the hinge connection 930. In other embodiments, the hinge connection can be positioned between the first set of openings 923 of the cap and at a corresponding location on the base 910, so regardless of the position of the hinge connection 930, the friction members 924 can contact the engagement members 912 to wrap around the portion of wire of the light string.

To ensure that the removable clamp 900 stays closed when the cap 920 is moved into the closed position, the base 910 can further comprise base friction members 916 designed to contact the inward-facing surface of the peripheral skirt 922 of the cap 910. The base friction members 916 are shaped and arranged to accommodate the engagement members 912 of the base 910.

In the closed position shown in FIG. 9A, the engagement members 912 contact the friction members 924 and the peripheral skirt 922 of the cap 920 engages with the base friction members 916 of the base 910. In the closed position, the ends of the engagement members 912 and the friction members 924 are exposed via the first set of openings 923 of the cap 920. With the present exemplary embodiment, the shapes of the engagement members 912 and friction members 924 are designed to accommodate the size and shape of the portion of wire to be wrapped.

FIG. 9C illustrates a bottom perspective view of the present exemplary embodiment of the removable clamp 900. In the present exemplary embodiment, the magnet 914 is also embedded in the base 910 and flush with the bottom surface of the base 910.

Figure 10A:
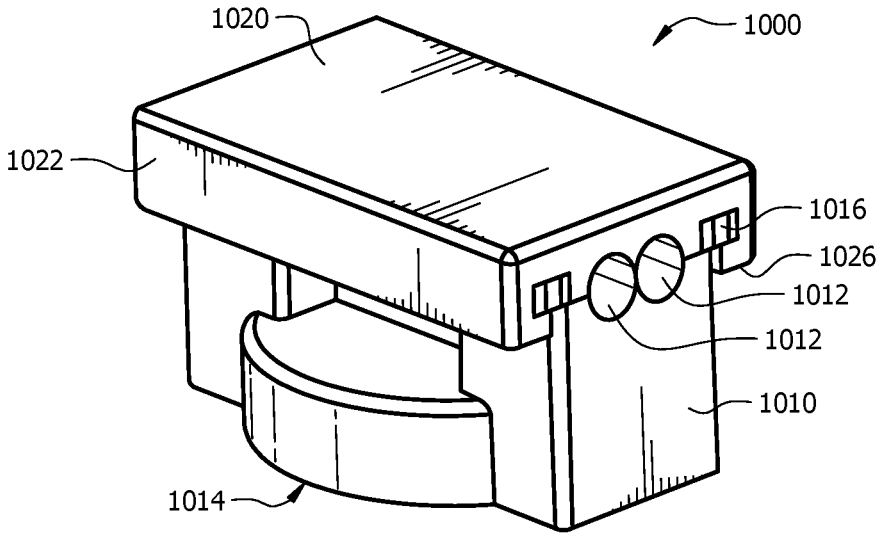
FIGS. 10A, 10B, and 10C illustrate a sixth exemplary embodiment of the removable clamp in accordance with the disclosed principles.
Figure 10B:
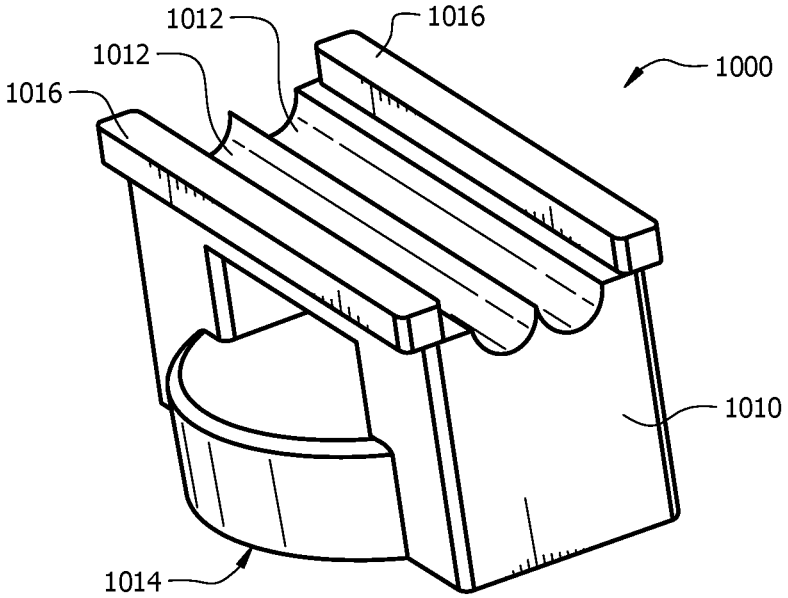
Figure 10C:
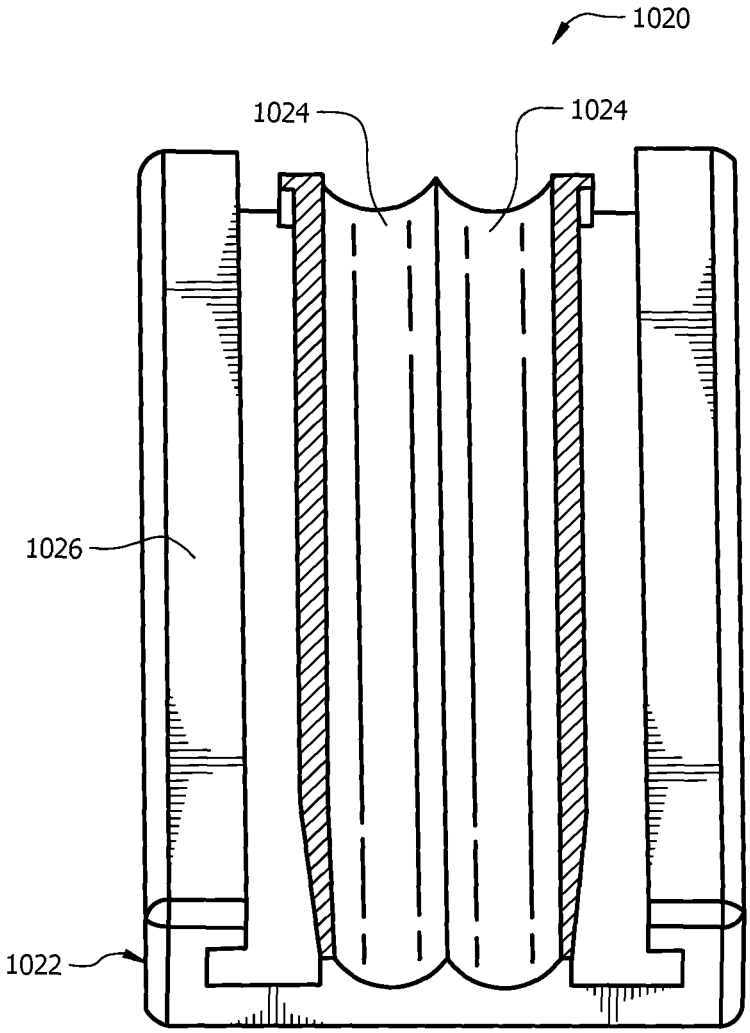

FIGS. 10A, 10B, and 10C illustrate another exemplary embodiment of the removable clamp in accordance with the disclosed principles. As with the previous exemplary embodiments, the present exemplary embodiment is designed to wrap around a portion of wire of a light string to facilitate the hanging of the light string on a metal surface on the outside of a building. The exemplary removable clamp 1000 comprises a base 1010 as shown in FIG. 10C and a cap 1020 as shown in FIG. 10B. FIG. 10A depicts the removable clamp 1000 in the closed position after the cap 1020 has engaged the base 1010 to form the closed position of the removable clamp 1000.

In the present exemplary embodiment, the open position of the removable clamp 1000 comprises exposing the engagement members 1012 of the base and the friction members 1024 of the cap 1020. As shown in FIG. 10B, the base 1010 is shaped to provide additional height between the magnet 1014 and the engagement members 1012. The base 1010 may comprise any shape to accommodate the magnet 1014 and the engagement members 1012, and in the present exemplary embodiment, the base comprises a generally rectangular shape. As with the previously described exemplary embodiments, the magnet 1014 is embedded in the base 1010 so that the magnet 1014 is flush with the bottom surface of the base 1010 and is opposite the engagement members 1012. The engagement members 1012 are positioned between the base friction members 1016, and similar to the previously described second exemplary embodiment, the engagement members 1012 are shaped as grooves to conform to the shape of the portion of wire of the light string. The engagement members 1012 and the base friction members 1016 span the length of the base 1010, and in other embodiments, the members 1012 and 1016 can vary in length.

FIG. 10C is a bottom view of the cap 1020 of the removable clamp 900. In the present exemplary embodiment, the cap 1020 has a shape corresponding to the shape of the base 1010, and is generally rectangular in shape. The friction members 1024 protrude from the bottom surface of the cap 1020 and are positioned between the peripheral skirt 1022 of the cap 1020. In the present exemplary embodiment, the peripheral skirt 1022 comprises a skirt rim 1026 designed to keep the base 1010 in place when the replacement clamp 1000 is in the closed position. In the present exemplary embodiment, the peripheral skirt 1022 is perpendicular to the bottom surface of the cap 1020, and the skirt rim 1026 protrudes from the end of the peripheral skirt 1022 in a perpendicular direction so that the skirt rim 1026 is parallel to the bottom surface of the cap 1020.

To achieve the closed position of the removable clamp 1000 as shown in FIG. 10A, the present exemplary embodiment allows the base 1010 to slide into the closed position. The base friction members 1016 of the base 1010 are lined up between the peripheral skirt 1022, the skirt rim 1026, and the bottom surface of the cap 1020. In the present exemplary embodiment, the base friction members 1016 are designed to fit between the bottom surface of the cap 1020 and the skirt rim 1026 so that the cap 1020 slides into place on top of the base 1010. By sliding the cap 1020 into place, the removable clamp 1000 provides a tighter and sturdier fit for the portion of wire of the light string so that the portion of wire does not as easily fall out. In other embodiments, the cap 1020 can be made from a more flexible material and thereby allowing the cap to clip around the base 1010, especially the base friction members 1016.

Figure 11A:
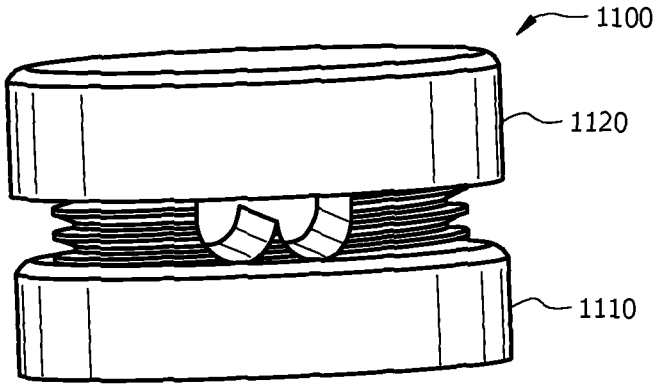
FIGS. 11A, 11B, and 11C illustrate a seventh exemplary embodiment of the removable clamp in accordance with the disclosed principles.
Figure 11B:
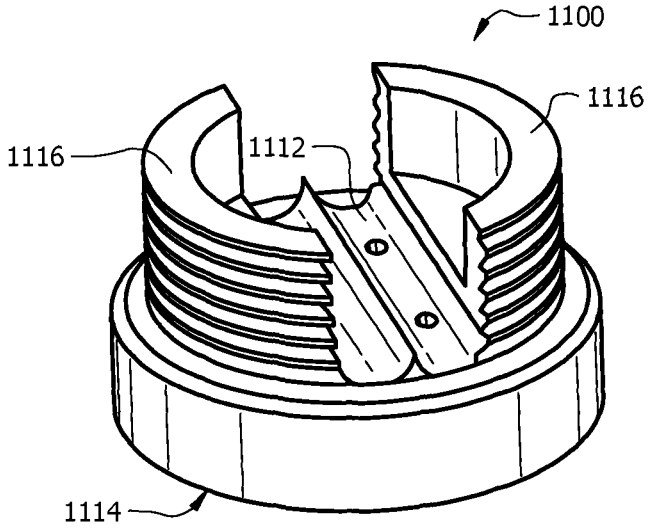
Figure 11C:
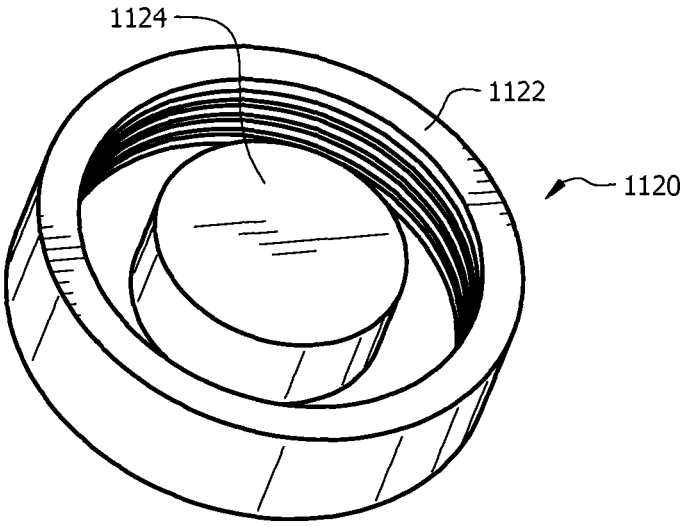

FIGS. 11A, 11B, and 11C illustrate another exemplary embodiment of the removable clamp in accordance with the disclosed principles. As with the previously described exemplary embodiments, the fourth exemplary embodiment of the removable clamp is designed to wrap around a portion of wire of a light string and to facilitate the hanging of the light string on metal surfaces on the outside of buildings. The present exemplary removable clamp 1100 comprises a base 1110 as shown in FIG. 11B and a cap 1120 as shown in FIG. 11C. FIG. 11A depicts the removable clamp 1100 in the closed position after the cap 1120 has engaged the base 1110 to form the closed position of the removable clamp 1100.

In the fourth exemplary embodiment, the open position of the removable clamp 1100 comprises exposing the engagement members 1112 of the base 1110 and the friction member 1124 of the cap 1120. As shown in FIG. 11B, the base 1110 comprises engagement members 1112 that are situated between threaded base friction members 1116, and similar to the previously described exemplary embodiments, the engagement members 1112 are shaped as grooved to conform to the shape of the portion of wire of the light string. The base 1110 further comprises a magnet 1114 embedded in the base 1110 so that the magnet 1114 is flush with the bottom surface of the base 1110 and is opposite the engagement members 1112.

FIG. 11C is a bottom view of the cap 1120 of the removable clamp 1100. In the fourth exemplary embodiment, the cap 1120 has a shape corresponding to the shape of the base 1120, and is circular in shape. In the present embodiment, the cap 1120 comprises a friction members 1124 that protrudes from the bottom surface of the cap 1120 and is surrounded by the peripheral skirt 1122 of the cap 1120. In the present exemplary embodiment, the peripheral skirt 1122 comprises threading on the surface facing the friction member 1124.

To achieve the closed position of the removable clamp 1100 as shown in FIG. 11A, the present exemplary embodiment allows the cap 1120 to screw onto the base 1110 to form the closed position. Because the inward-facing surface of the peripheral skirt 1122 is threaded and the outward-facing surface of the base friction members is counter-threaded, the threading of the base 1110 and the cap 1120 allows for the cap 1120 to be screwed onto the base 1110. With a portion of wire situated between the base friction members 1116, in the closed position, the friction member 1124 of the cap 1120 applies downward force onto the portion of wire to secure the portion of wire of the light string.

A method for installing a system of removable clamps for hanging a light string is also provided. A location is selected on a ferrous metal surface. Using a first removable clamp, a portion of wire of the light string is selected and positioned between the engagement members of a base of the first removable clamp. The first removable clamp can be any removable clamp of the previously described exemplary embodiments. The cap of the first removable clamp is then closed from the open position to form the closed position. At this point, the portion of wire of the light string is secured by the first removable clamp, and the removable clamp is attached to the selected location on the ferrous metal surface via the magnet embedded in the base of the clamp. In case the first removable clamp needs to be removed, the first removable clamp is removed from the selected location and then opened from the closed position to the open position, thereby releasing the portion of wire from the engagement members of the base of the clamp.

The invention may be embodied in other specific forms without departing from the spirit or essential characteristics thereof. The present embodiments are therefore to be considered in all respects as illustrative and not restrictive. Accordingly, the scope of the invention is established by the appended claims rather than by the foregoing description. All changes which come within the meaning and range of equivalency of the claims are therefore intended to be embraced therein. Further, the recitation of method steps does not denote a particular sequence for execution of the steps. Such method steps may therefore be performed in a sequence other than recited unless the particular claim expressly states otherwise.

The invention claimed is:

1. A removable clamp for a light string, comprising:

a base comprising engagement members and an attachment mechanism;

wherein the attachment mechanism is configured to allow attachment of the removable clamp to a surface of a building;

a cap, wherein the cap is attached to the base at one side and is movable between a closed position and an open position, wherein the cap comprises a peripheral skirt and friction members, wherein the friction members are configured to engage with the engagement members to secure the cap to the base, wherein the peripheral skirt comprises a first set of openings positioned on a plane perpendicular to a top surface of the base in the closed position and the friction members are arranged to form a second set of openings on the plane perpendicular to the top surface of the base in the closed position, wherein the first set of openings and the second set of openings are configured such that when the cap is in the closed position, a portion of the light string can fit within a passageway formed by the first set of openings and the second set of openings; and wherein the open position of the cap exposes the engagement members of the base.

2. The removable clamp of claim 1, wherein the attachment mechanism comprises a magnet attached to the base.

3. The removable clamp of claim 2, wherein the magnet does not protrude outside of the base.

4. The removable clamp of claim 2, wherein the magnet is a neodymium magnet.

5. The removable clamp of claim 2, wherein the magnet is a disc ½ inch in diameter and ⅛ inch thick.

6. The removable clamp of claim 2, wherein the magnet is embedded flush with a bottom surface of the base, wherein the magnet is opposite the engagement members.

7. The removable clamp of claim 1, wherein the removable clamp is made from plastic.

8. The removable clamp of claim 1, wherein a cross-sectional area of the base is circular.

9. The removable clamp of claim 1, wherein a cross-sectional area of the base is rectangular.

10. The removable clamp of claim 1, wherein the attachment mechanism comprises tabs protruding outwardly.

11. The removable clamp of claim 1, wherein the attachment mechanism comprises a circular ring radiating outwardly.

12. The removable clamp of claim 1, wherein the attachment mechanism comprises a hook opposite the engagement members.

13. A removable clamp for a light string, comprising:

a base comprising engagement members and an attachment mechanism;

wherein the attachment mechanism is configured to allow attachment of the removable clamp to a surface of a building; and a cap, wherein the cap comprises a peripheral skirt and a set of friction members, wherein the set of friction members is configured to engage with the engagement members to secure the cap to the base, wherein the peripheral skirt comprises a first set of openings positioned on a plane perpendicular to a top surface of the base and the set of friction members is arranged to form a second set of openings on the plane perpendicular to the top surface of the base, wherein the first set of openings and the second set of openings are configured such that when the cap is in a closed position, a portion of the light string can fit within a passageway formed by the first of openings and the second set of openings.

14. The removable clamp of claim 13, wherein the attachment mechanism comprises a magnet attached to the base.

15. The removable clamp of claim 14, wherein the magnet does not protrude outside of the base.

16. The removable clamp of claim 14, wherein the magnet is a neodymium magnet.

17. The removable clamp of claim 14, wherein the magnet is a disc ½ inch in diameter and ⅛ inch thick.

18. The removable clamp of claim 14, wherein the magnet is embedded flush with a bottom surface of the base facing away, wherein the magnet is opposite the engagement members.

19. The removable clamp of claim 13, wherein the removable clamp is made from plastic.

20. The removable clamp of claim 13, wherein a cross-sectional area of the removable clamp is circular.

21. The removable clamp of claim 13, wherein the cap is a screw top with first set of threads along an interior surface of the peripheral skirt and the base further comprises a base skirt with a second set of threads along an exterior surface, and the cap engages the base via the first set of threads and the second set of threads.

22. The removable clamp of claim 13, wherein the attachment mechanism comprises tabs protruding outwardly.

23. The removable clamp of claim 13, wherein the attachment mechanism comprises a circular ring radiating outwardly.

24. The removable clamp of claim 13, wherein the attachment mechanism comprises a hook opposite the engagement members.

25. A method for installing a system of removable clamps for hanging a light string, said method comprising the steps of:

positioning a portion of a wire of the light string between engagement members of a base of a first removable clamp of the system of removable clamps;

closing a cap of the first removable clamp into a closed position from an open position, wherein the cap comprises a peripheral skirt and a friction member, wherein the friction member is configured to engage with the engagement members to secure the cap to the base, wherein the peripheral skirt comprises a first set of openings positioned on a plane perpendicular to a top surface of the cap, and the friction member comprises a second set of openings on the plane perpendicular to the top surface of the cap, wherein the first set of openings and the second set of openings are configured such that when the cap is in the closed position, a portion of the light string can fit within a passageway formed by the first set of openings and the second set of openings; and attaching the base to a selected location on a surface of a building.

26. The method of claim 25, further comprising selecting the location containing a ferrous metal surface.

27. The method of claim 26, further comprising:

opening the cap of the first removable clamp from the closed position into the open position, wherein the open position exposes the engagement members of the base;

removing the portion of the wire from the engagement members of the base.

28. The method of claim 26, where the base comprises tabs protruding outwardly.

29. The method of claim 26, wherein the base comprises a circular ring radiating outwardly.

30. The method of claim 26, wherein the base comprises a hook opposite the engagement members.

31. The method of claim 25, wherein a magnet is attached to the base of the first removable clamp.

32. The method of claim 31, wherein the magnet is a neodymium magnet.

33. The method of claim 31, wherein the magnet is a disc ½ inch in diameter and ⅛ inch thick.

34. The method of claim 31, wherein the magnet is embedded flush with a bottom surface of the base facing away, wherein the magnet is opposite the engagement members.

35. The method of claim 25, wherein the first removable clamp is made from plastic.

* * * * *